United States Patent [19]

Stoll

[11] 4,305,448

[45] Dec. 15, 1981

[54] SERVO CONTROL MECHANISM FOR A CURTAIN

[76] Inventor: Kurt Stoll, Lenzhalde 72, 7300 Esslingen, N., Fed. Rep. of Germany

[21] Appl. No.: 93,340

[22] Filed: Nov. 13, 1979

[30] Foreign Application Priority Data

Nov. 16, 1978 [DE] Fed. Rep. of Germany ..... 2849669

[51] Int. Cl.[3] ..... A47H 5/02

[52] U.S. Cl. ..... 160/331; 91/DIG. 4; 92/175

[58] Field of Search ..... 160/331, 330, DIG. 16, 160/388, 83 A; 92/175; 91/DIG. 4

[56] References Cited

U.S. PATENT DOCUMENTS

| | | | |
|---|---|---|---|
| 2,005,546 | 6/1935 | Jenkins | 160/331 |
| 2,588,779 | 3/1952 | Van Der Stigchel | 160/331 |
| 2,973,231 | 2/1961 | Reynolds | 92/175 X |
| 3,370,639 | 2/1968 | Von Brimer | 160/331 |
| 3,550,376 | 12/1970 | Esteve | 92/175 X |
| 3,779,401 | 12/1973 | Carroll | 91/DIG. 4 |

*Primary Examiner*—Rodney H. Bonck

*Attorney, Agent, or Firm*—Blanchard, Flynn, Thiel, Boutell & Tanis

[57] ABSTRACT

A servo control mechanism for controlling the reciprocal movement of a piston member along the length of a curtain rod. The curtain rod is composed of a fluid pressure-tight tubular member made of a nonmagnetic material and having pressurized fluid supply ports therein adapted to supply pressure to opposite sides of the reciprocal piston member. A plurality of ring members, certain ones of which are made of magnetizable material, surround the curtain rod and are capable of movement along the length of the rod. A plurality of permanent magnets are reciprocally mounted inside the curtain rod and are magnetically coupled to certain ones of the curtain rings which are made of a magnetizable material. An elongated strand extends between the piston member and at least one of the permanent magnet members inside of the curtain rod so that a driven movement of the piston member will cause a forced movement of the permanent magnet therewith. The magnetic coupling between the permanent magnet and the curtain ring will cause a movement of the curtain ring with the piston member.

22 Claims, 5 Drawing Figures

SERVO CONTROL MECHANISM FOR A CURTAIN

The invention relates to a servo control mechanism for the control of the opening and closing movements of curtains.

BACKGROUND OF THE INVENTION

In such conventional servo-operated curtains, the controllable drive mechanism—as a rule an electric motor—works on a curtain cord, which is secured to a curtain ring which is adjacent to the free curtain end. Such servo controls are, however, susceptible to trouble.

The present invention is a further development of a servo control mechanism in such a manner that a higher operating safety is achieved.

Starting out from the state of the art, this purpose is inventively attained by providing a servo control mechanism for a curtain supported by a curtain rod through at least one curtain ring, which servo control mechanism has a controllable drive means operating on the curtain ring. The curtain rod is of a tubular construction and is made of a nonmagnetizable material. A piston is movably supported inside the curtain rod with opposite sides thereof being selectively supplied with pressurized fluid. An elongated strand effects a coupling of the piston to at least one permanent magnet also movably mounted inside the curtain rod. The curtain ring surrounds the curtain rod and is made of a magnetizable material and, consequently, is magnetically coupled to the permanent magnet inside the curtain rod. If more than one ring is used, only certain ones of the rings are made of magnetizable material and the number of permanent magnets equals the number of such rings.

The inventive servo control mechanism has the further advantage that it is totally out of the sight of the viewer. It moreover also operates practically without any sound, is service free, and the closing and opening speed of the curtain can be varied simply by a suitable control of the pressure, with which the piston which runs in the curtain rod is loaded. The inventive servo control consists of mechanically simple parts and can thus be produced inexpensively and can be easily installed. It can also be used easily in rooms, where otherwise special, explosion-protected electrical systems would have to be used.

Since two magnets are directly connected to opposite sides of the piston, they can take over the guiding task and the piston can thus be optimized with respect to its sealing function.

In addition, it is achieved that in the case of a possible tilting of the magnets, a jamming in the curtain rod is not possible, since the effective cross section remains the same.

BRIEF DESCRIPTION OF THE DRAWINGS

The invention will be discussed in more detail hereinbelow with reference to one exemplary embodiment and with reference to the enclosed drawings, in which.

DETAILED DESCRIPTION

Figure 1:
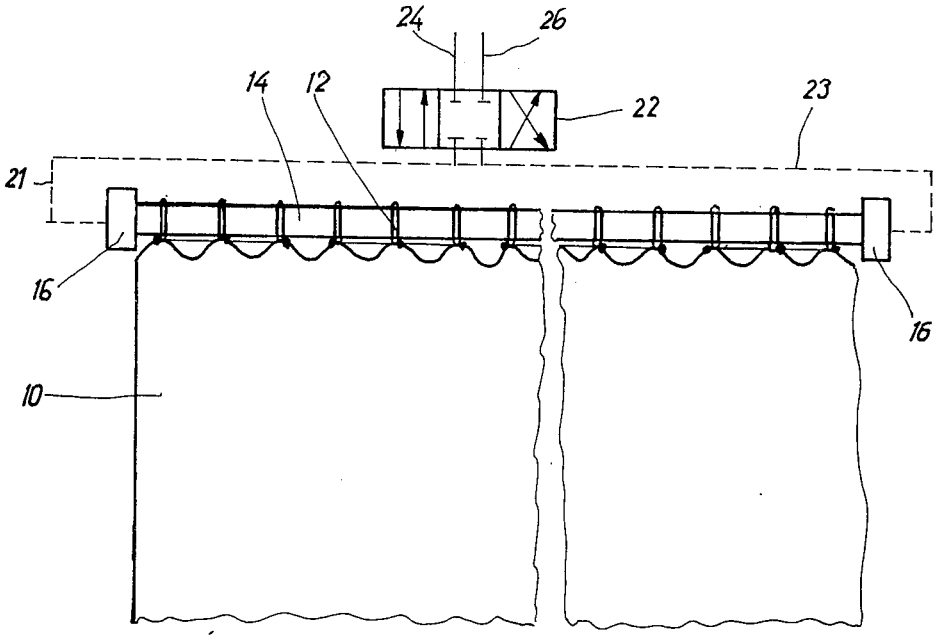
FIG. 1 is a schematic of a servo-operated curtain and an associated pressure-medium supply.

FIG. 1 illustrates a one-piece curtain 10 in a closed condition, which hangs on a cylindrical curtain rod 14 by means of curtain rings 12. The curtain rod is fixedly connected to a wall through two fastening blocks 16.

Figure 2:
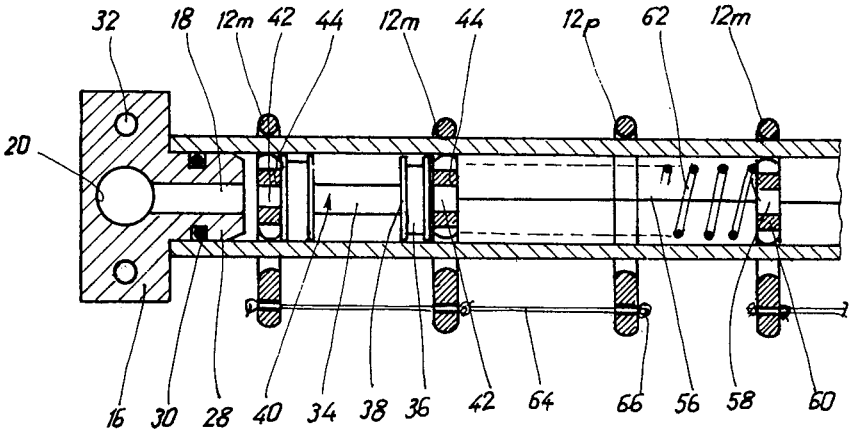
FIG. 2 is an axial or central longitudinal cross-sectional view of an end section of the curtain rod in an enlarged scale.

As can best be seen from FIG. 2, the curtain rod 14 is constructed as an elongated pipe-shaped hollow member, and same consists of a nonmagnetic material, for example plastic, brass or anodized aluminum.

The fastening blocks 16 have an axially extending channel 18 therein, which is connected to a radially extending opening 20, which in turn can be connected through a line 21 or 23 and a three-position valve 22, which lines in turn can be selectively connected to a pressure fluid supply line 24 or a low-pressure fluid supply line 26. The pressure line 24 is connected to the pressure outlet side of a compressor (not illustrated), the low-pressure line 26 communicates with the atmosphere. The fastening blocks each have a cylindrical shoulder 28, in which is located the channel 18 and which, sealed off by an O-ring packing 30, is inserted into one of the ends of the curtain rod 14. Openings 32 in the fastening blocks 16 facilitate a fastening of the blocks to the wall.

A double piston 40 is reciprocally movable in the cylinder which is formed by the curtain rod 12 and the fastening blocks 16, which piston has two piston heads 36 which are connected by a rod 34. Each one of the piston heads 36 has two thin, axially spaced, radially extending flanges 38. Stub end sections 42 of the rod 34 project axially beyond each of the piston heads 36. The double piston 40 is a one-piece injection molded part of a plastic having a low friction coefficient characteristic.

Figure 3:
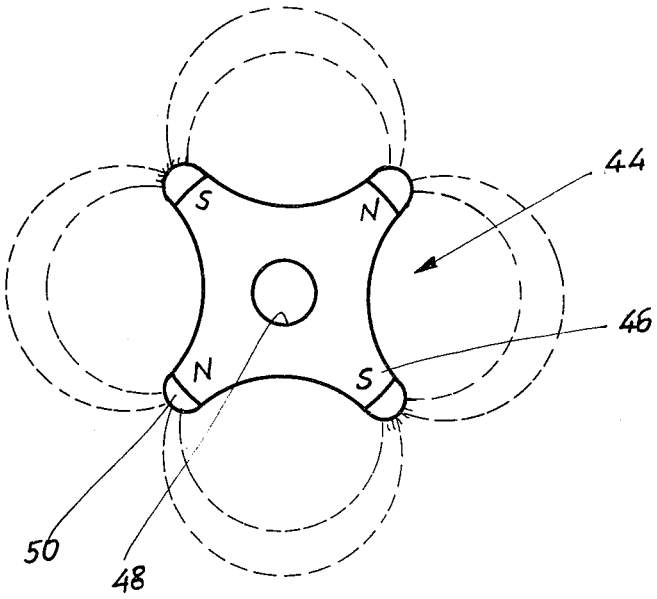
FIG. 3 is a view of one of the axially facing sides of the permanent magnets, which serve to carry along curtain rings through a piston of the servo control mechanism.

Radially polarized, star-shaped permanent magnets 44 with plural arms 46 and a central opening 48, as they are illustrated in more detail in FIG. 3, are mounted in a press or forced fit on the stub end sections 42 of the rod 34. The length of the arms 46 is chosen such that the maximum diameter of the permanent magnet array 44 is slightly smaller than the inside diameter of the curtain rod 14.

The outer surface of the arms 46 are spherically shaped as at 50 having a radius, which corresponds with the inner radius of the curtain rod 14.

The two permanent magnets 44 which are mounted on the opposite end sections 42 simultaneously provide a radial guiding of the double piston 40 inside the curtain rod 14 so that the radial flanges 38 do not have to do so. In order to make sliding of the permanent magnets 44 on the inner wall of the curtain rod 14 easier, the spherically shaped ends 50 are coated with a plastic material, for example polytetrafluoroethylene, having a low friction characteristic.

Figure 4:
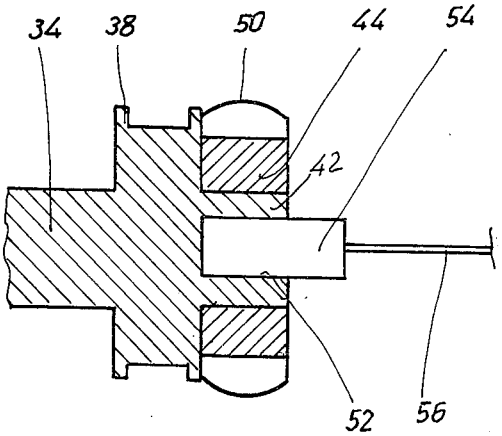
FIG. 4 is a cross-sectional view of the end of the piston of the servo control mechanism, which end lies on the right, the associated permanent magnets and the associated end of a flexible pulling means, with which further permanent magnets are connected.

The end section 42 which is on the right of FIG. 2 (compare FIG. 4) has an axially extending recess 52 therein, into which a head piece 54 having a flexible plastic wire or strand 56 secured thereto is inserted and held therein by frictional resistance. The plastic wire 56 has at regular intervals thickened portions 58 (compare FIG. 2), the outside diameter of which corresponds with the outside diameter of the end sections 42. Further permanent magnets 60 are mounted on the thickened portions 58, which magnets 60 are constructed identical to the previously described permanent magnets 44. A helical spring 62, the outside diameter of which is slightly smaller than the inside diameter of the curtain rod 14 and the axial dimension of which is smaller than the spacing between the thickened portions 58, is provided between the permanent magnets which are connected by the thin, highly flexible sections of the plastic strand 56.

A portion of the curtain rings 12 which travel along the outside of the curtain rod 14 consists of a magnetic material, for example iron. These curtain rings are identified by the reference numeral 12*m* in the drawings. To improve their running characteristics and at the same time as a protection against corrosion, the curtain rings 12*m* are coated on the outside with a thin sliding plastic layer. The curtain rings 12*m* are each attracted to one of the associated permanent magnets 44 and 60, and through them the magnetic flow is short-circuited from one of the arms 46 to the oppositely poled adjacent arm. During movement of the permanent magnets 44 and 60, the associated curtain rings 12*m* are carried along therewith.

Other ones of the curtain rings, which are identified by the reference numeral 12*p* in the drawings, consist of a nonmagnetic plastic material having a low friction characteristic and are used only to carry the curtain 10, however, are not used for movement. The curtain rings 12*p* are pulled along by the curtain rings 12*m* namely through cords 64, in which suitable carrier knots 66 are provided. In the present embodiment, each one of the magnetic curtain rings 12*m* has associated with it a curtain ring 12*p* which consists of plastic; naturally it is also possible for a magnetic curtain ring 12*m* to pull a larger number of plastic curtain rings 12*p*. The distance between the carrier knots 66 is chosen such that, when the curtain 10 is closed, the desired formation of folds is obtained.

OPERATION

The above described servo-operated curtain rod operates as follows:

In the illustrated position of the valve 22 in FIG. 1, the double piston 40 is fluidically locked. If the valve spool is shifted to the right, the double piston 40 is loaded through the line 21 from the left with pressure and moves together with the permanent magnets 44 to the right. The permanent magnets 44 carry along the curtain rings 12*m* which are associated with them and the corresponding section of the curtain 10. After a predetermined length of travel, the first one of the plastic curtain rings 12*p* is carried along by the curtain ring 12*m* which lies on the left side thereof, and later on the permanent magnet 60 which lies further to the right is carried along then by the helical spring 62, thus also the curtain ring 12*m* which is associated with said permanent magnet 60. The latter curtain ring 12*m* grabs then during the further course of the opening movement the next plastic curtain ring 12*p* and so on.

In this manner, the curtain is successively moved together and is folded into equally large folds. When the double piston 40 reaches its end position which is on the right side and which lies, because of the helical springs 62 and the space which is taken up by the curtain folds, quite a ways before the fastening block 16 which is on the right, then the valve 22 is again moved into the neutral or center position.

For the subsequent closing of the curtain, the valve spool is shifted to the left, so that the line 23 is supplied with pressurized fluid. The double piston 40 is now moved to the left and carries along through its two permanent magnets 44 the first curtain rings 12*m*. As soon as the slack in the cord 64 has been taken up, the carrier knot 66 of the curtain ring 12*b* reacts on same, which causes same to start to move. After a further length of travel, the slack in the section of the plastic wire 56, which section lies between the right permanent magnet 44 and the permanent magnet 60 is tensioned and the permanent magnet 60 starts to move together with its curtain ring 12*m;* the next plastic curtain ring 12*p* is then also carried along through the associated cord 64 after a predetermined length of travel, etc., until the double piston 40 reaches its left end position which is shown in FIG. 2.

It is understood that it is also possible to stop the double piston 40 in any desired centered position and to fluidically lock same.

A reversing curtain can be realized simply by using instead of the left or right one of the fastening blocks 16 a fastening block with two oppositely positioned shoulders 28 and by mounting on each of the two shoulders a curtain rod, which is closed off at the outer end by a fastening block 16.

Figure 5:
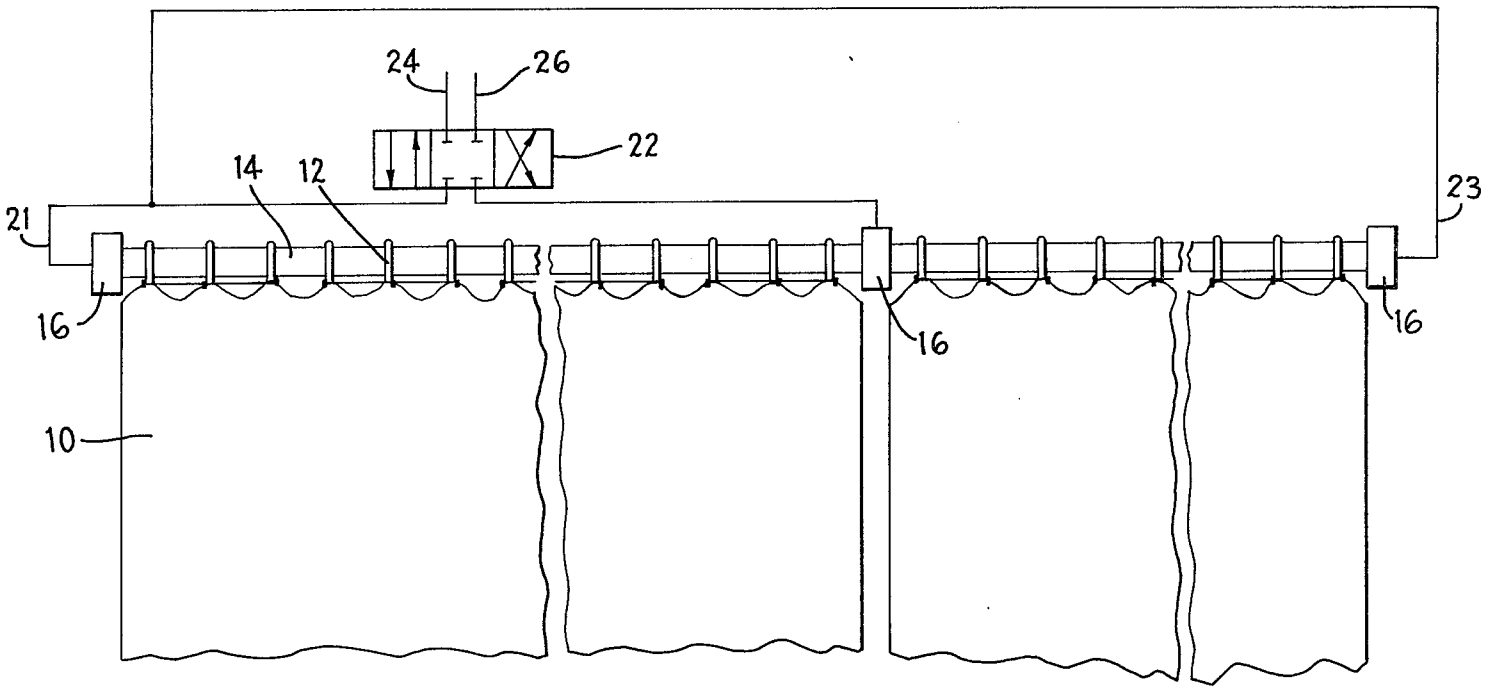
FIG. 5 is a schematic of a servo-operated two-section curtain movable from the ends of the curtain rod toward the center thereof.

It is to be understood that the invention can also be incorporated into a curtain rod having two pistons arranged therein which each travel to one side of its center as shown in FIG. 5. The reference numerals used in FIG. 5 are the same as used in FIG. 1. Accordingly, further discussion about FIG. 5 is believed unnecessary. At the center of the curtain rod there is provided an additional pressure medium supply block 16.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a servo control mechanism for a curtain, which is suspended from curtain rings slidably mounted on a curtain rod, comprising a controllable drive means operatively connected to at least one of said curtain rings, the improvement comprising wherein said curtain rod is tubular, closed at both ends and consists of a nonmagnetic material; wherein inside of said curtain rod there is a movable piston selectively loadable from one of the two closed ends of said curtain rod by a pressure medium; and wherein said piston is slidingly movably supported in said curtain rod and has at least one magnet magnetically coupled to at least one of said curtain rings which consists of a magnetic material, said magnet being radially polarized.

2. The servo control mechanism according to claim 1, wherein said piston has two piston heads which are connected by a rod.

3. The servo control mechanism according to claim 1 or 2, wherein said piston is molded out of plastic.

4. The servo control mechanism according to claim 1, wherein said magnet has a central opening.

5. The servo control mechanism according to claim 4, wherein said magnet is mounted by a forced fit on an end section of said piston.

6. The servo control mechanism according to claim 5, wherein the outer surface of said magnet is a spherical surface.

7. The servo control mechanism according to claim 1, wherein the outer surface of said magnet is coated with a plastic material having a low friction characteristic.

8. The servo control mechanism according to claim 1, wherein said magnet has radial arms.

9. The servo control mechanism according to one of the claims 6 to 8, wherein said piston has thin, radial flanges.

10. The servo control mechanism according to claim 1, wherein a row of magnets are connected to said piston through flexible pulling means of a predetermined length.

11. The servo control mechanism according to claim 10, wherein said magnets are mounted by frictional resistance on a through-going flexible pulling means.

12. The servo control mechanism according to claim 11, wherein said pulling means has at predetermined intervals thickened portions, on which the central openings of said magnets are positioned by frictional resistance, and thin and highly flexible sections which lie therebetween.

13. The servo control mechanism according to claim 11 or 12, wherein the one end of said pulling means is provided with a head, which is fixed in a central recess of the piston in a frictionally tight connection.

14. The servo control mechanism according to claim 11 or 12, wherein the one end of said pulling means is provided with a head, which is fixed in a central recess of the piston in a snap fit connection.

15. The servo control mechanism according to claim 10, wherein between said magnets there are arranged elastic spacing members, the length of which is less than the predetermined length of said pulling means which connect the permanent magnets.

16. The servo control mechanism according to claim 15, wherein said spacing members are helical springs, the radial dimension of which is smaller than the inside radius of said curtain rod.

17. The servo control mechanism according to claim 1, wherein nonmagnetic further curtain rings are connected through flexible pulling means of a predetermined length to said magnetic curtain ring.

18. The servo control mechanism according to claim 1, wherein said curtain ring which consists of a magnetic material is coated with a plastic material having a low friction characteristic.

19. The servo control mechanism according to claim 1, wherein cylindrical head pieces are provided and engage the ends of said curtain rod, are formed on fastening blocks to facilitate the mounting of the curtain rod on the wall and are provided with pressure-medium channels.

20. The servo control mechanism according to claim 1, wherein said curtain rod is coated with a plastic material having a low friction characteristic.

21. The servo control mechanism according to claim 1, wherein in said curtain rod there are arranged two pistons which each travel to one side of its center and at the center of the curtain rod there is provided an additional pressure-medium supply or discharge channel.

22. The servo control mechanism according to claim 1, wherein said curtain rod consists of brass.

* * * * *